US010029355B2

(12) United States Patent
Doggett

(10) Patent No.: US 10,029,355 B2
(45) Date of Patent: Jul. 24, 2018

(54) DRIVER BITS ADAPTED FOR BOTH WRENCHES AND BIT SCREWDRIVERS

(71) Applicant: DOGGETT ENTERPRISES INCORPORATED, Thunder Bay, Ontario (CA)

(72) Inventor: Robert S. Doggett, Thunder Bay (CA)

(73) Assignee: DOGGETT ENTERPRISES INCORPORATED, Ontario (CA)

( * ) Notice: Subject to any disclaimer, the term of this patent is extended or adjusted under 35 U.S.C. 154(b) by 345 days.

(21) Appl. No.: 14/578,265

(22) Filed: Dec. 19, 2014

(65) Prior Publication Data

US 2016/0176028 A1 Jun. 23, 2016

(51) Int. Cl.
*B25B 23/00* (2006.01)
*B25B 15/00* (2006.01)

(52) U.S. Cl.
CPC ..... *B25B 23/0035* (2013.01); *B25B 15/001* (2013.01)

(58) Field of Classification Search
CPC ..... B25B 23/0035; B25B 15/001
USPC ..... 81/60–63.2
See application file for complete search history.

(56) References Cited

U.S. PATENT DOCUMENTS 3,253,626 A * 5/1966 Stillwagon, Jr. ..... B25B 23/12 29/DIG. 27
5,351,586 A * 10/1994 Habermehl ..... B25B 13/06 81/438
5,531,143 A * 7/1996 Habermehl ..... B25B 13/06 81/438
5,884,541 A * 3/1999 Habermehl ..... B25B 13/06 279/155
5,918,512 A * 7/1999 Habermehl ..... B25B 13/06 81/177.75
6,332,382 B1 * 12/2001 Anderson ..... B25B 15/001 81/125
6,352,011 B1 * 3/2002 Fruhm ..... B25B 23/0035 81/436
6,511,268 B1 * 1/2003 Vasudeva ..... B23B 31/1071 279/14
6,868,758 B2 * 3/2005 Chen ..... B25B 13/462 81/60
6,968,758 B2 * 11/2005 Lin ..... B25B 13/462 81/176.1
7,156,002 B1 * 1/2007 Chan ..... B25B 15/001 81/177.4
7,836,801 B2 * 11/2010 Huang ..... B25B 15/001 40/913
8,876,121 B2 * 11/2014 Hu ..... B25B 23/0035 279/143
9,314,907 B2 * 4/2016 Wang ..... B25B 15/001 81/448
9,339,918 B2 * 5/2016 Chang ..... B25B 13/06 81/180.1
2002/0135140 A1 * 9/2002 Mitchell ..... B25B 15/001 279/79

(Continued)

*Primary Examiner* — David B Thomas
(74) *Attorney, Agent, or Firm* — Techlaw LLP; Sam K. Tahmassebi

(57) ABSTRACT

A driver bit for applying torque to a fastener with both wrenches and bit screwdrivers comprising: a) a drive portion comprising: i) a hexagonal shank portion, and ii) a holder portion comprising a collar or a groove that is capable of accommodating a C-clip; and b) a working head portion.

20 Claims, 6 Drawing Sheets

(56) References Cited

U.S. PATENT DOCUMENTS

| | | | | |
|---|---|---|---|---|
| 2004/0226413 | A1* | 11/2004 | Chen | B25B 13/462 81/60 |
| 2009/0324326 | A1* | 12/2009 | Lin | B25B 15/001 403/322.2 |
| 2012/0006160 | A1* | 1/2012 | Wang | B25B 15/001 81/438 |
| 2013/0186243 | A1* | 7/2013 | Harper | B25B 23/00 81/180.1 |
| 2013/0340578 | A1* | 12/2013 | Lai | B25B 15/005 81/460 |
| 2015/0075333 | A1* | 3/2015 | Chen | B25B 13/463 81/61 |
| 2016/0059394 | A1* | 3/2016 | Hu | B25B 23/0035 81/60 |

* cited by examiner

DRIVER BITS ADAPTED FOR BOTH WRENCHES AND BIT SCREWDRIVERS

FIELD OF THE INVENTION

The present disclosure relates to a driver bit, and more particularly, to a driver bit with a holder that is positioned along the driver bit's shank to allow for torque to be applied to a fastener using the driver bit with bit screwdrivers and wrenches, at least. The position of the holder enables the driver bit to be used with open or closed box wrenches, a gear ratchet wrenches or a deep socket ratcheting wrench, and bit screwdrivers. The present disclosure also relates to a driver bit, and more particularly, to a driver bit that employs a holder comprising a collar or groove that accommodates a C-clip or a suitable retainer, which affords a stop that that is suitably positioned along the shank of the driver bit to allow for the expanded use with both bit screwdrivers and wrenches.

BACKGROUND OF THE DISCLOSURE

The prior art discloses various driver bits and driver retention kits. However, the prior art does not provide a bit retention mechanism that can be used with bit screwdrivers and a variety of wrenches. Widely used bit dimensions of ¼ inch (as measured from parallel hexagonal faces) in width by 1 inch in length are provided with a variety of working heads (e.g., Standard, Robertson, Philips™, hex Allen™, Torx™, Philips™ Ribbed, Philips™ Slotted, Pozi Philips™, Hex, Torx®, Spline, Roberts, Security, Tri Wing, Clutch, etc.).

The length of the bit's shank portion is typically long enough to expose a portion of the shank above the tool that is large enough to finger grip for rotation. These dimensions are a compromise between the ergonomic limitations and a desire the keep the space used by the combination of the tool and bit suitable for tight spaces. The exposed portion of the shank above the holder limits the drive bit from being used with both bit screwdrivers and wrenches. In this instance, the holder is positioned too low on the shank, thereby exposing a length of shank above the holder that is unsuited for the expanded use with both bit screwdrivers and wrenches.

Therefore, the present disclosure is provides an improved driver bit employing a variety of working heads that is compatible with both bit screwdrivers and wrenches.

SUMMARY OF THE INVENTION

In one embodiment, the disclosed device is a driver bit for applying torque to a fastener with both wrenches and bit screwdrivers comprising: a) a drive portion comprising: i) a hexagonal shank portion, and ii) a holder portion comprising a collar or a groove that is capable of accommodating a C-clip; and b) a working head portion.

DETAILED DESCRIPTION OF THE EMBODIMENTS

The following is a detailed description of certain specific embodiments of the devices disclosed herein. In this description reference is made to the drawings presented herein.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

In one aspect, disclosed herein are driver bits for applying torque to fasteners with both wrenches and bit screwdrivers comprising:

a) a drive portion comprising:

i. hexagonal shank portion, and ii. a holder portion comprising a collar or a groove that is capable of accommodating a C-clip; and b) a working head portion.

FIGS. 1-6 illustrate embodiments pertaining to driver bits for applying torque to a fastener with both wrenches and bit screwdrivers.

Figure 1C:
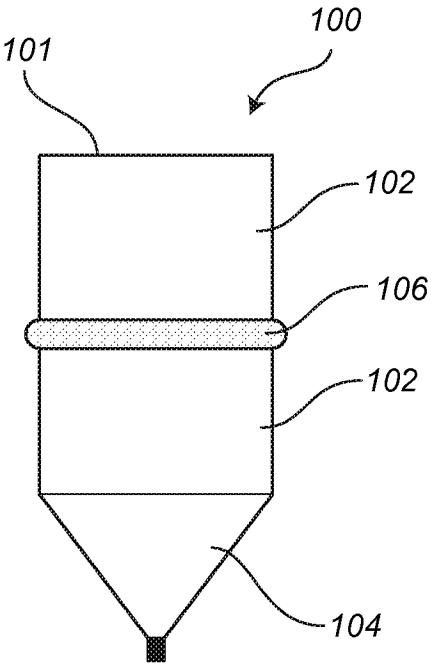
FIG. 1C is a side view illustration of a driver bit 100 in accordance with the present disclosure with a C-clip 106.
Figure 1B:
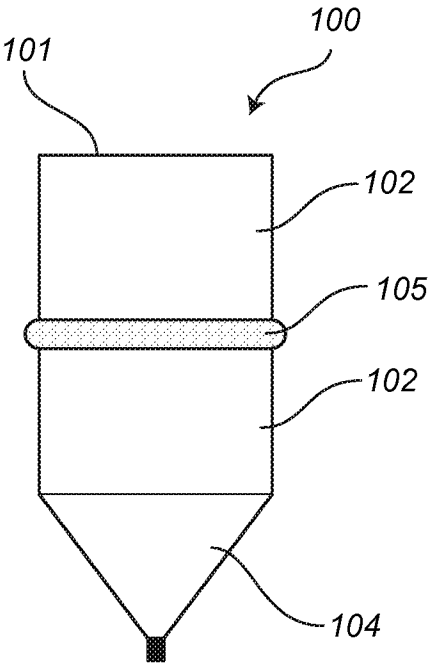
FIG. 1B is a side view illustration of a driver bit 100 in accordance with the present disclosure with a collar 105.
Figure 1A:
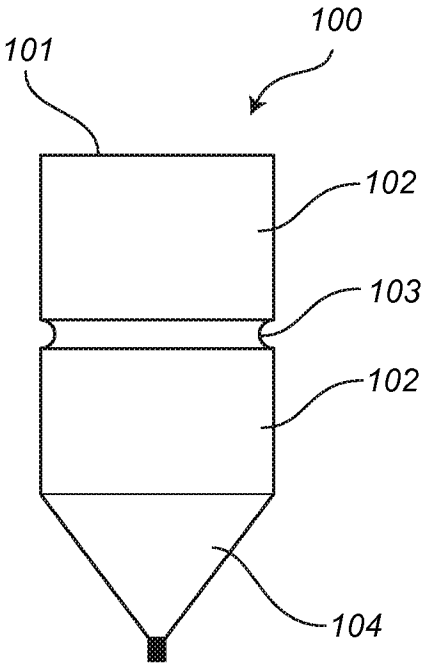
FIG. 1A is a side view illustration of a driver bit 100 in accordance with the present disclosure with a groove 103.

In this aspect, FIG. 1A depicts a side view illustration of a driver bit 100 in accordance with the present disclosure with a groove 103. As shown in FIG. 1A, the shank portion comprises a groove 103 with a shank portion between the groove 103 and the top of the shank 101 and a shank portion 102 between the working head 104 and the groove 103. In some embodiments, the groove is a concave ring groove with a diameter of between about ⅛ inch to about ¼ inch. In some embodiments, the groove is a concave ring groove with a diameter of about 7/32 inches. As illustrated with FIG. 1C, the groove 103 is occupied with a C-clip 106, which represents a holder portion. In some embodiments, a first length of the shank portion extends from the holder to the top of the driver bit of between about ⅛ inch to about ⅝ inches, wherein the first length is the shank portion on the same side of the holder as the top of the driver bit. In some embodiments, a first length of the shank portion extends from the holder to the top of the driver bit of between about ¼ inch to about ½ inch, wherein the first length is the shank portion on the same side of the holder as the top of the driver bit. In some embodiments, the C-clip 106 fits the groove and extends past the shank of between about 1/16 inch to about ¼ inch. In some embodiments, the C-clip 106 fits the groove and extends past the shank of between about 1/32 inch to about 1/16 inch. In some embodiments, the C-clip 106 fits the groove and extends past the shank by about 1/16 inch. In some embodiments, the C-clip 106 has a free diameter of between about 0.1 inches to about 0.32 inches. In some embodiments, the C-clip 106 has a free diameter of between about 0.2 inches to about 0.28 inches. In some embodiments, the C-clip 106 has a free diameter of between about 0.21 inches to about 0.23 inches. In some embodiments, the C-clip 106 has a free diameter of about 0.228 inches.

The driver bit 100 of FIG. 1B lacks the groove 103, and instead comprises a collar 105 formed during the production or subsequent to production of the driver bit to afford a holder portion. In some embodiments, the collar extends past the outer diameter of the shank of between about 1/16 inch to about ¼ inch. In some embodiments, the collar extends past the outer diameter of the shank of between about 1/32 inch to about 1/16 inch. In some embodiments, the collar extends past the outer diameter of the shank by about 1/16 inch.

One key feature of the present invention is to provide a bit that can be used with both wrenches and bit screwdrivers. Accordingly, the driver bit 100 of the present disclosure comprises a holder portion positioned at a distance from the top 101 of the driver bit that is suitable for use with wrenches and bit screwdrivers. In some embodiments, the first length of the shank portion extends from the holder portion to the top of the driver bit about ¼ inch. In some embodiments, the driver bit has a length of between about 11/16 inches and about 15/16 inches. In some embodiments, the driver bit has a length of about ¾ inches as illustrated with FIGS. 2B and 3B. As illustrated with FIG. 3B, the shank is approximately flush with the face of the wrench, thereby allowing for working in tight clearance areas.

Figure 2A:
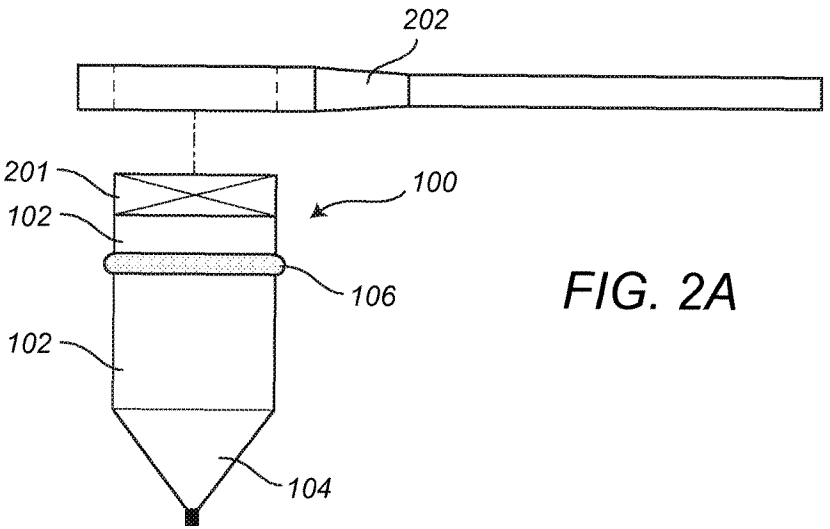
FIG. 2A is a side view illustration of a driver bit 100 with a C-clip 106 and a wrench 202 engaging with the driver bit with the optional shank portion 201.
Figure 2B:
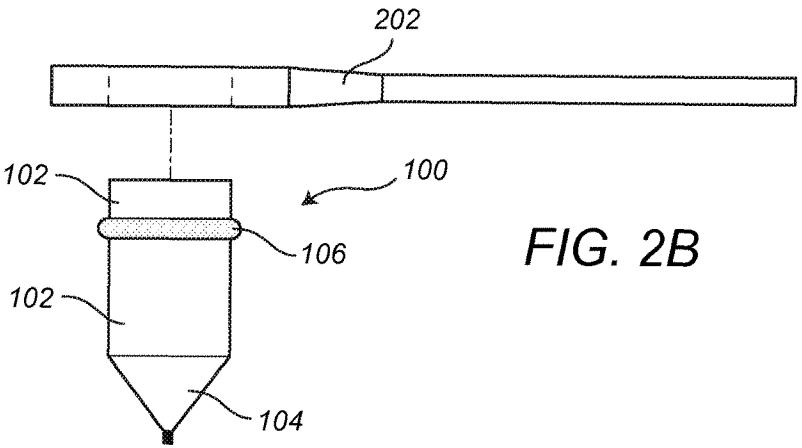
FIG. 2B is a side view illustration of a driver bit 100 with a C-clip 106 and a wrench 202 engaging with the driver bit without the optional shank portion 201.
Figure 3A:
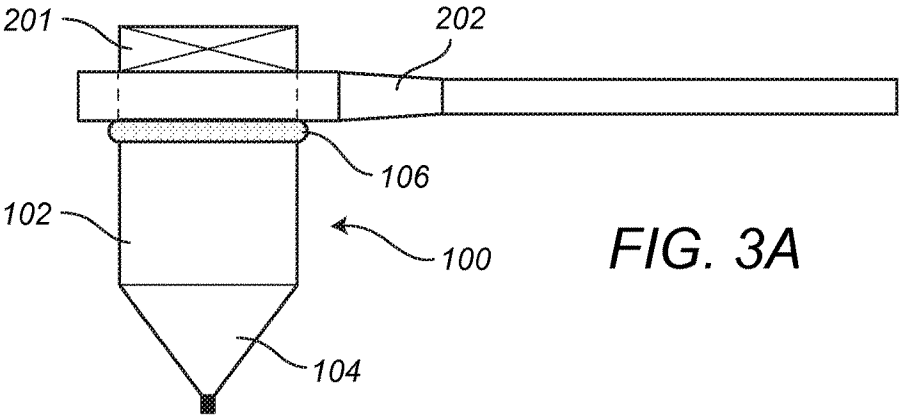
FIG. 3A is a side view illustration of a driver bit 100 with a C-clip 106 and a wrench 202 engaged with the driver bit with the optional shank portion 201.
Figure 3B:
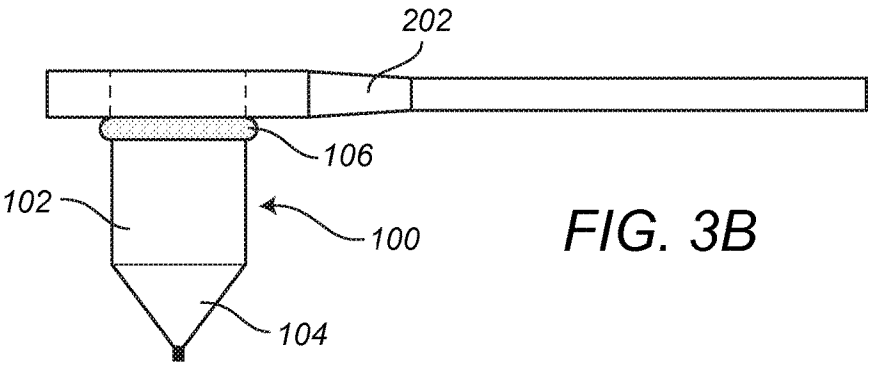
FIG. 3B is a side view illustration of a driver bit 100 with a C-clip 106 and a wrench 202 engaged with the driver bit without the optional shank portion 201.

In another embodiment, a wrench 202 as shown in FIGS. 2A and 2B is illustrated. In some embodiments, the driver bit is capable of having torque applied with a 6-point wrench, 12-point wrench, a 6-point bit screwdriver or a 12-point bit screwdriver. In some embodiments, the wrench is an open or closed box wrench, a gear ratchet wrench or a deep socket ratcheting wrench. In some embodiments, the bit screwdriver is a ratcheting bit screwdriver or a standard bit screwdriver. In some embodiments, the hexagonal shank is a ¼ inch hexagonal drive or a 5/16 inch hexagonal drive.

In some embodiments, the driver bit has a length of between about 15/16 inches and about 1 1/16 inches. In some embodiments, the driver bit has a length of about 1 inch as illustrated with FIGS. 2A and 3A. In some embodiments, the first length of the shank portion extends from the holder portion to the top 101 of the driver bit is about ½ inch. As illustrated with FIG. 2A, an optional shank portion 201 of about ¼ inch allows for the use of a finger turn knob 401 presented with FIG. 4.

Figure 4B:
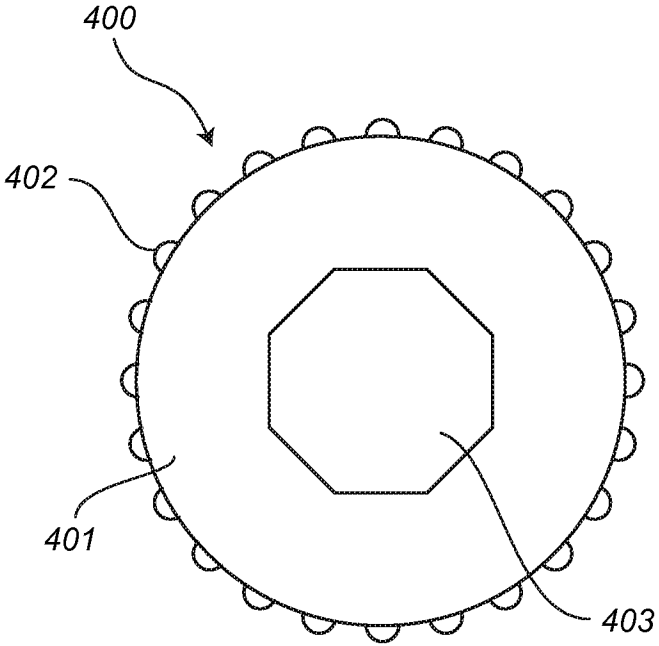
FIG. 4B is a top view illustration of a finger turn knob 401.
Figure 4A:
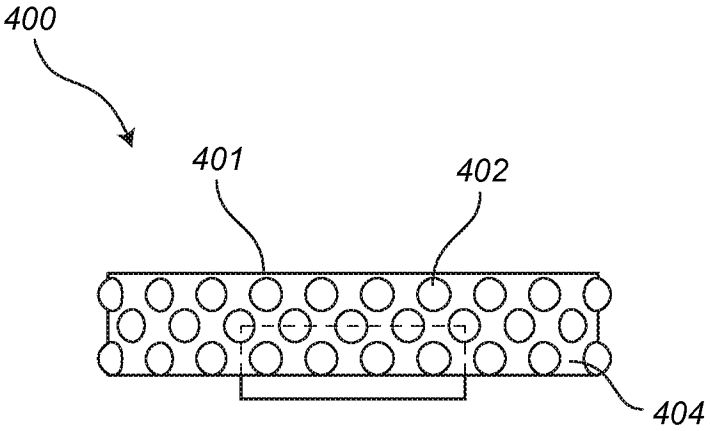
FIG. 4A is a side view illustration of a finger turn knob 401.
Figure 5:
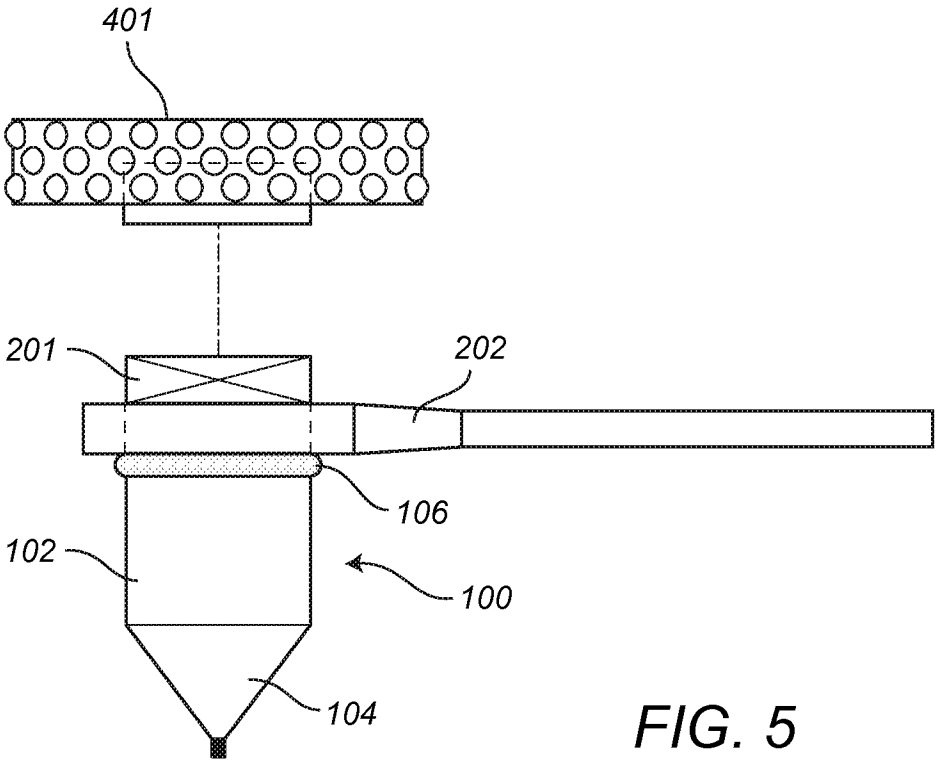
FIG. 5 is a side view illustrating the engagement of the finger turn knob 401 with the optional shank portion 201 of the driver bit 100 as engaged with the wrench 202.

In some embodiments, the driver bit further comprises a finger turn knob 401 comprising a female hexagonal portion sized to fit the top of the driver bit to manually rotate the driver bit. As illustrated with FIG. 5, the finger turn knob 401 comprises a female hexagonal portion 403 and a surface or protrusions 402 for grippingly rotating the driver bit herein. In some embodiments, the driver bit further comprises a finger turn knob 401 comprising a female hexagonal portion sized to fit the top of the driver bit 403 to manually rotate the driver bit. In some embodiments, the finger turn knob is magnetic. In some embodiments, the finger turn knob is capable of being grippingly rotated with a rubber, metal, plastic surface or protrusions spaced at intervals around the outer circumference of the knob. For Example, the protrusions 402 are provided on the surface with a depth of between 0.001 to 0.2 inches. However, the geometry, depth and height of the protrusions can be varied. The geometry of the protrusions can consist of squares, ridges, rectangles, diamonds, triangles, etc. or combinations thereof. As shown in FIG. 4B, the protrusions 402 can vary in height across the surface 404. Moreover, the protrusions 402 may extend slightly above or below the surface 404.

Figure 6B:
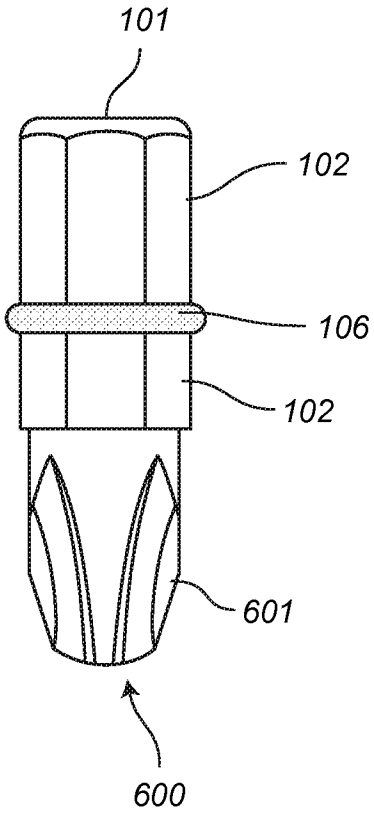
FIG. 6B is a side view illustration of an example of a driver bit herein with a Philips™ head screwdriver 601 with a C-clip 106 as the holder portion.
Figure 6A:
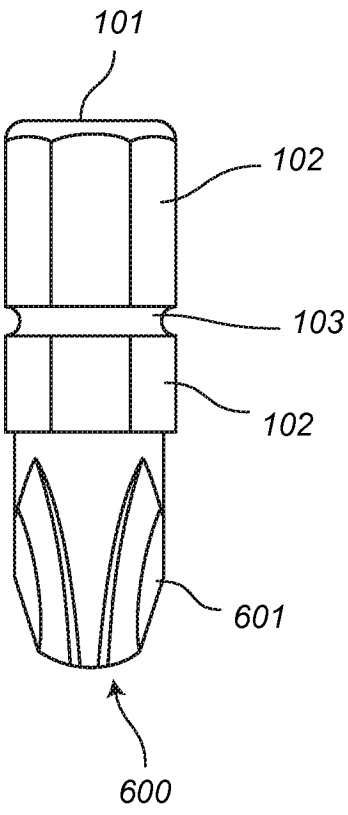
FIG. 6A is a side view illustration of an example of a driver bit herein with a Philips™ screwdriver as the working head 601 with the groove 103.

As depicted with FIG. 6, the driver bit 600 may comprise a Philips™ head as the work head portion 601. In some embodiments, the working end of the driver bit is a Standard, Robertson, Philips™, hex Allen™, Torx™, Philips™ Ribbed, Philips™ Slotted, Pozi Philips™ Hex, Torx®, Spline, Roberts, Security, Tri Wing or Clutch, etc. The driver bit 100 of the present invention can be modified to be used with other retention mechanisms (e.g., magnetic retention, o-ring, etc.), to further the retention properties of the bit. In some embodiments, the hexagonal shank portion extends from the rearward end of the driver bit to the working end with the holder portion positioned therebetween. In some embodiments, the driver bit is magnetic.

Thus, advantageously, the present invention a bit and driver tool that can be manufactured easily, and that can be used with both wrenches and bit screwdrivers. In some embodiments, the driver bit is manufactured from steel, stainless steel, titanium, alloy, or combinations thereof. In some embodiments, the groove and collar are each independently formed during the manufacturing process. In some embodiments, the groove and collar are each independently formed subsequent to the manufacturing process of the driver bit.

The presently disclosed devices are not to be limited in scope by the specific embodiments described herein, which are intended as single illustrations of individual aspects of the presently disclosed devices, and functionally equivalent methods and components are within the scope of the presently disclosed devices. Indeed, various modifications of the presently disclosed devices, in addition to those shown and described herein will become apparent to those skilled in the art from the foregoing description and accompanying drawings. Such modifications are intended to fall within the scope of the appended claims.

What is claimed is:

1. A driver bit for applying torque to a fastener with either a wrench or a bit screwdriver comprising:

a) a drive portion comprising:

i. a hexagonal shank portion, and ii. a holder portion comprising a C-clip placed within a collar or a groove; and b) a working head portion;

wherein the hexagonal shank fits a 6-point wrench, 12-point wrench, a 6-point bit screwdriver or a 12-point bit screwdriver torque applicator; and wherein the wrench is an open or closed box wrench, a gear ratchet wrench or a deep socket ratcheting wrench.

2. The driver bit of claim 1, wherein a first length of the shank portion extends from the holder to the top of the driver bit of between about ¼ inch to about ½ inch, wherein the first length is the side of the holder that is closer to the top of the driver bit.

3. The driver bit of claim 1, wherein a first length of the shank portion extends from a first side of the holder portion to the top of the driver bit is about ¼ inch.

4. The driver bit of claim 1, wherein a first length of the shank portion extends from a first side of the holder portion to the top of the driver bit is about ½ inch.

5. The driver bit of claim 4, further comprising a finger turn knob comprising a female hexagonal portion sized to fit the top of the driver bit to manually rotate the driver bit.

6. The driver bit of claim 5, wherein the finger turn knob is magnetic.

7. The driver bit of claim 5, wherein the finger turn knob is grippingly rotated with a rubber, metal, plastic surface or protrusions spaced at intervals around the outer circumference of the knob.

8. The driver bit of claim 1, wherein the driver bit has a length of about ¾ inches.

9. The driver bit of claim 1, wherein the driver bit has a length of between about ¾ inch to about 1 inch.

10. The driver bit of claim 1, wherein the hexagonal shank is a ¼ inch hexagonal drive or a 5/16 inch hexagonal drive.

11. The driver bit of claim 1, wherein the bit screwdriver is a ratcheting bit screwdriver or a standard bit screwdriver.

12. The driver bit of claim 1, wherein the driver bit is magnetic.

13. The driver bit of claim 1, wherein the collar extends past the outer diameter of the shank of between about 1/32 inch to about 1/16 inch.

14. The driver bit of claim 1, wherein the groove is a concave ring groove with a diameter of about 7/32 inches.

15. The driver bit of claim 1, wherein the C-clip fits the groove and extends past the shank of between about 1/32 inch to about 1/16 inch.

16. The driver bit of claim 1, wherein the C-clip has a free diameter of between about 0.2 inches to about 0.28 inches.

17. The driver bit of claim 1, wherein the C-clip has a free diameter of about 0.228 inches.

18. The driver bit of claim 1, wherein the hexagonal shank portion extends from the rearward end of the driver bit to the working end with the holder portion positioned therebetween.

19. The driver bit of claim 1, wherein the working end of the driver bit is a Standard, Robertson, Philips™, hex Allen™, Torx™, Philips™ Ribbed, Philips™ Slotted, Pozi Philips™, Hex, Torx®, Spline, Roberts, Security, Tri Wing or Clutch.

20. A driver bit for applying torque to a fastener with both wrenches and bit screwdrivers comprising:

a) a drive portion comprising:

i. a hexagonal shank portion, and ii. a holder portion comprising a C-clip placed within a collar or a groove that; and b) a working head portion;

wherein the driver bit is manufactured from steel, stainless steel, titanium, alloy, or combinations thereof, wherein the groove and collar are each independently formed during the manufacturing process or the groove and collar are formed subsequent to the manufacturing process of the driver bit.

* * * * *